US006615630B2

(12) United States Patent
Wu et al.

(10) Patent No.: US 6,615,630 B2
(45) Date of Patent: Sep. 9, 2003

(54) DOOR LOCK

(75) Inventors: Rong-Faa Wu, Chia-Yi (TW); Kun-Chen Tsai, Chia-Yi (TW); Po-Yang Chen, Chia-Yi (TW)

(73) Assignee: Tong-Lung Metal Industry Co., Ltd., Chia-Yi (TW)

( * ) Notice: Subject to any disclaimer, the term of this patent is extended or adjusted under 35 U.S.C. 154(b) by 0 days.

(21) Appl. No.: 09/730,093

(22) Filed: Dec. 5, 2000

(65) Prior Publication Data

US 2002/0066297 A1 Jun. 6, 2002

(51) Int. Cl.[7] ..... E05B 13/10

(52) U.S. Cl. ..... 70/472; 70/149; 70/223; 70/224; 292/336.3

(58) Field of Search ..... 70/472, 221–224, 70/149; 292/336.3

(56) References Cited

U.S. PATENT DOCUMENTS

| | | | | | |
|---|---|---|---|---|---|
| 3,621,685 | A | * | 11/1971 | Sargent | 70/107 |
| 3,922,896 | A | * | 12/1975 | Kagoura | 70/223 |
| 4,920,773 | A | * | 5/1990 | Surko, Jr. | 70/224 |
| 5,018,375 | A | * | 5/1991 | Tully | 70/472 |
| 5,040,391 | A | * | 8/1991 | Lin | 70/472 X |
| 5,101,752 | A | * | 4/1992 | Smollar et al. | 70/472 X |
| 5,372,025 | A | * | 12/1994 | Lin | 70/472 |
| 5,868,018 | A | | 2/1999 | Kang | 70/472 |
| 5,941,108 | A | * | 8/1999 | Shen | 70/467 |
| 6,021,654 | A | * | 2/2000 | McCaa | 70/149 |
| 6,041,630 | A | * | 3/2000 | Shen | 70/472 |
| 6,085,561 | A | * | 7/2000 | Yao | 70/472 |
| 6,101,856 | A | * | 8/2000 | Pelletier et al. | 70/472 |
| 6,151,934 | A | * | 11/2000 | Chong et al. | 70/221 |
| 6,216,500 | B1 | * | 4/2001 | Kang | 70/224 |
| 6,223,567 | B1 | * | 5/2001 | Fadul | 70/149 |
| 6,279,360 | B1 | * | 8/2001 | Shen | 70/224 |
| 6,357,270 | B1 | * | 3/2002 | Vazquez | 70/472 |
| 6,425,273 | B1 | * | 7/2002 | Kim et al. | 70/224 |

* cited by examiner

*Primary Examiner*—Suzanne Dino Barrett
(74) *Attorney, Agent, or Firm*—Ladas & Parry

(57) ABSTRACT

A door lock includes an outside spindle tube, an insert tube which is disposed inside the outside spindle tube and which has a latch operating tab, and a clutch member disposed inside the insert tube and having first and second axial grooves. The clutch member is movable axially between a first position, in which the first axial groove engages a first engaging member projecting inwardly from the outside spindle tube, and a second position, in which the first axial groove disengages from the first engaging member. The insert tube does not engage the first engaging member of the outside spindle tube, but has a second engaging member in engagement with the second axial groove of the clutch member. When the door lock is placed in a locking position by pressing an inside press button of the door lock, the spindle shaft connected with the press button moves the clutch member to the second position, thereby permitting the outside spindle tube to turn independently of the insert tube. As such, possible damage due to the forced turning of the outside handle during the locking state of the door lock can be avoided.

7 Claims, 4 Drawing Sheets

DOOR LOCK

BACKGROUND OF THE INVENTION

1. Field of the Invention

The invention relates to a door lock, and particularly to a door lock including an outside spindle tube connected to an outside handle, an insert tube disposed inside the outside spindle tube and having a latch operating tab, and a clutch to hold together the outside spindle tube and the insert tube for simultaneous rotation or to separate the same for independent rotation of the outside spindle tube from the insert tube.

2. Description of the Related Art

Cylindrical locks generally include inside and outside handles respectively connected to inside and outside spindle tubes to actuate a latch mechanism that controls the opening and closing of a door. The inside spindle tube is provided with a press button, whereas the outside spindle tube incorporates a key-operated lock and an insert tube formed with a latch operating element for operating the latch mechanism so as to control a latch bolt of the latch mechanism. When the press button is pressed, the outside handle and the outside spindle tube are locked from rotation. In this situation, the outside handle and the outside spindle tube can be rotated only after the key-operated lock is actuated by a key. However, in many cases, the user may rotate forcefully the outside handle in the locked state as he/she cannot see whether or not the press button is pressed at the inside of the door. The frequent or forced rotation of the handle in the locked state can damage the interior structure of the door lock.

An improved door lock designed to alleviate the aforesaid problem is suggested in U.S. Pat. No. 5,868,018. In the door lock disclosed therein, an inside inner spindle, which has a latch operating tab and which is inserted into a spindle tube, is movable axially inside the spindle tube so as to be engageable with or disengageable from the spindle tube for simultaneous rotation when an inside press button is not pressed, or for permitting independent rotation of the spindle tube when the press button is pressed at the inside of a door. The spindle tube further receives an inside outer spindle which is axially spaced apart from the inside inner spindle and which is engageable with or disengageable from the inside inner spindle like a clutch. When the inside outer spindle is rotated by an operating shaft projecting from a core or plug of a key-operated lock, the inside outer spindle can rotate the inside inner spindle which is in engagement therewith, thus operating a latch bolt to open the door and releasing the press button from a pressed state.

SUMMARY OF THE INVENTION

The object of the present invention is to provide a door lock in which an outside spindle tube can be rotated in a locked state of the door lock.

According to the present invention, a door lock includes: an inside handle incorporating a press button; an outside handle; an outside spindle tube including a first end connected to the outside handle, a second end opposite to the first end, and a first engaging member projecting radially inward from the second end; an insert tube inserted into the outside spindle tube through the second end, and including a third end adjacent the second end, a fourth end extending inside the outside spindle tube, and a latch operating tab which projects from the third end to extend outwardly of the third end and which is adapted to operate a latch operating mechanism, the insert tube further having an inner wall and a second engaging member projecting inwardly from the inner wall; a clutch member disposed inside the insert tube and having an outer peripheral surface formed with first and second axial grooves, the second axial groove engaging the second engaging member of the insert tube, the clutch member being axially movable between a first position in which the first engaging member engages slidably the first groove and a second position in which the first engaging member disengages from the first groove; a spring disposed inside the insert tube to urge the clutch member toward the second end so as to place the clutch member in the first position; and a spindle rod having one end connected to the press button and another end connected to the clutch member so as to move the clutch member to the second position when the press button is pressed.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
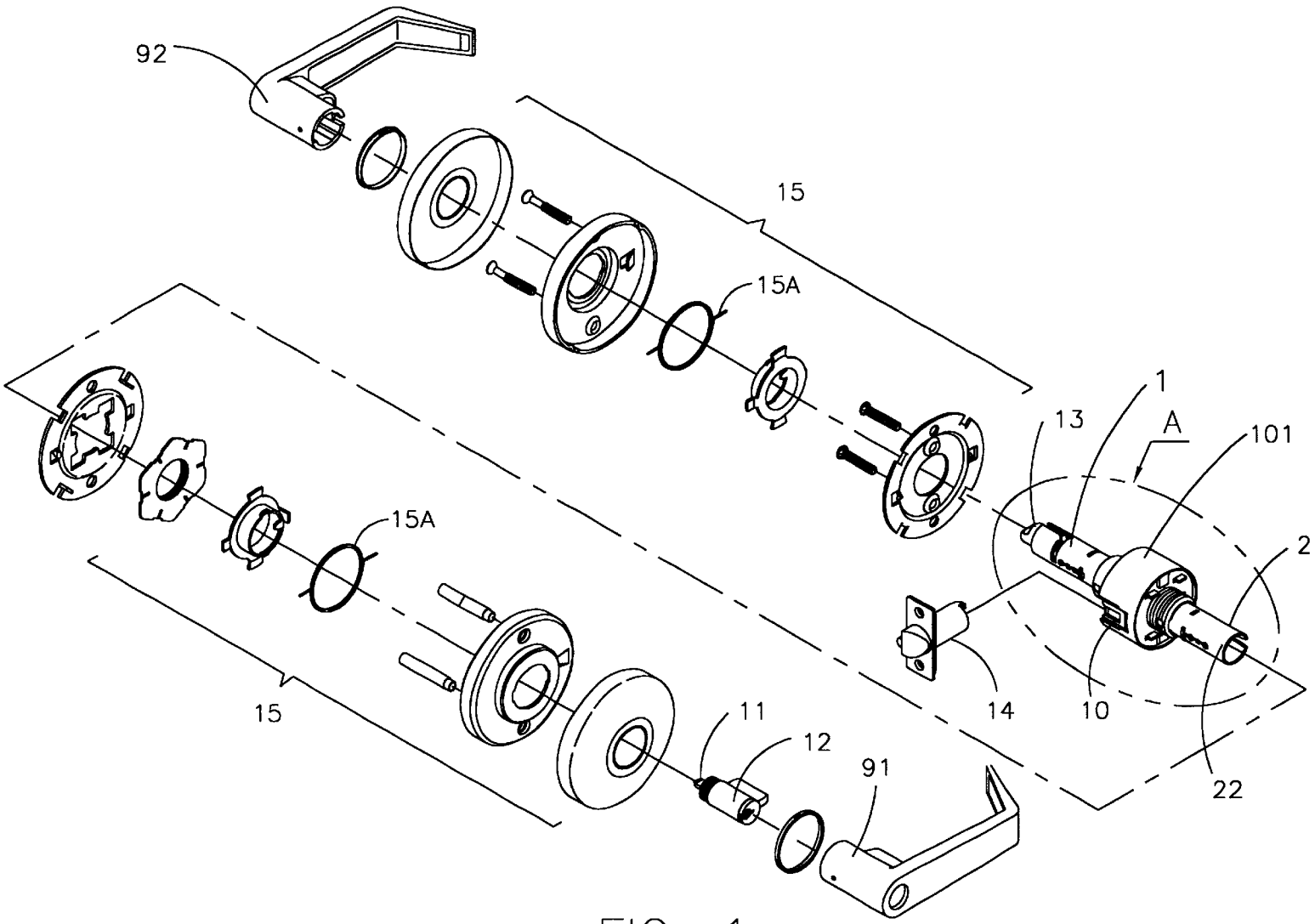
FIG. 1 is an exploded view of a door lock embodying the present invention.
Figure 2:
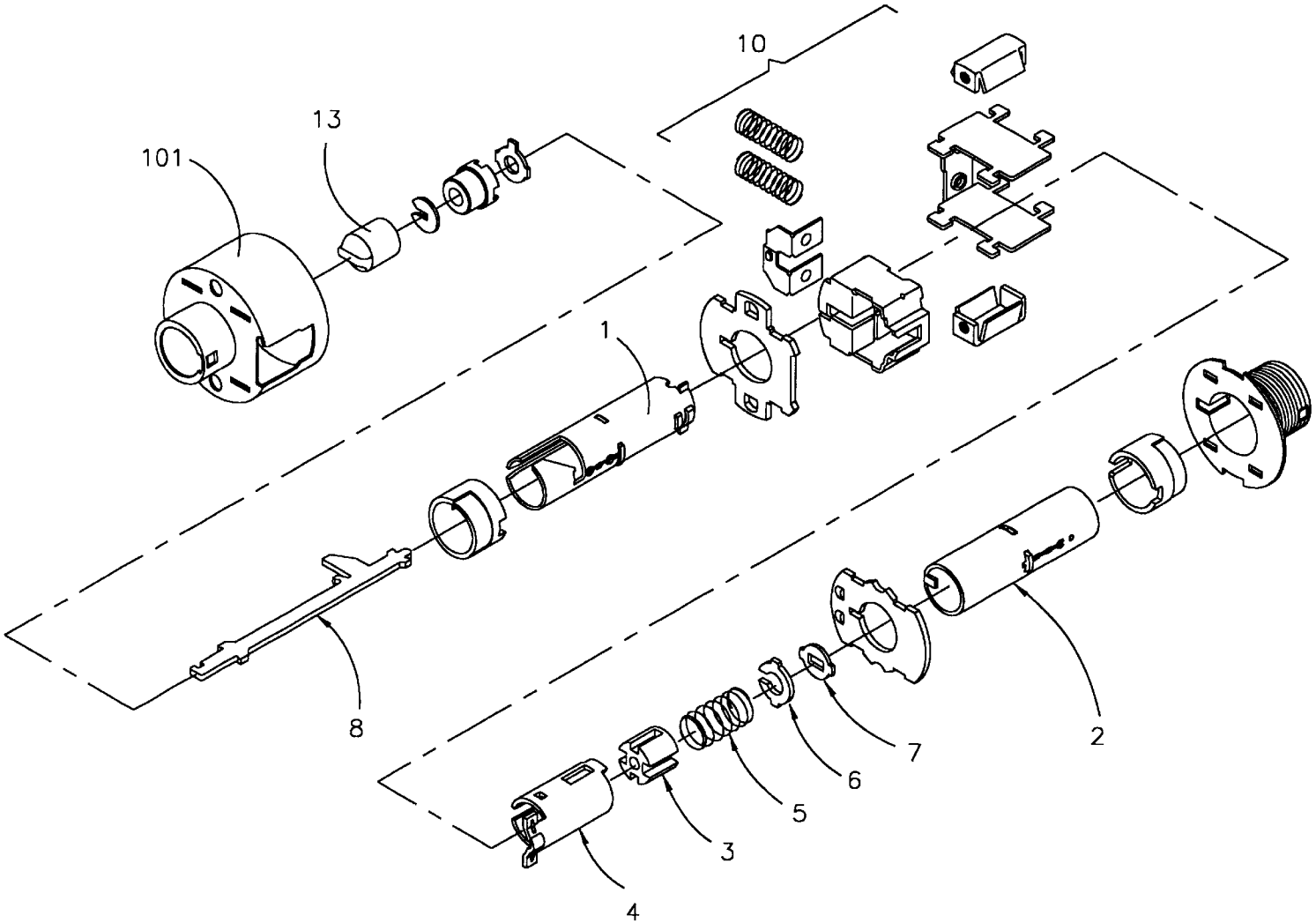
FIG. 2 is an exploded view of parts of the door lock encircled by a ring "A" in FIG. 1.
Figure 3:
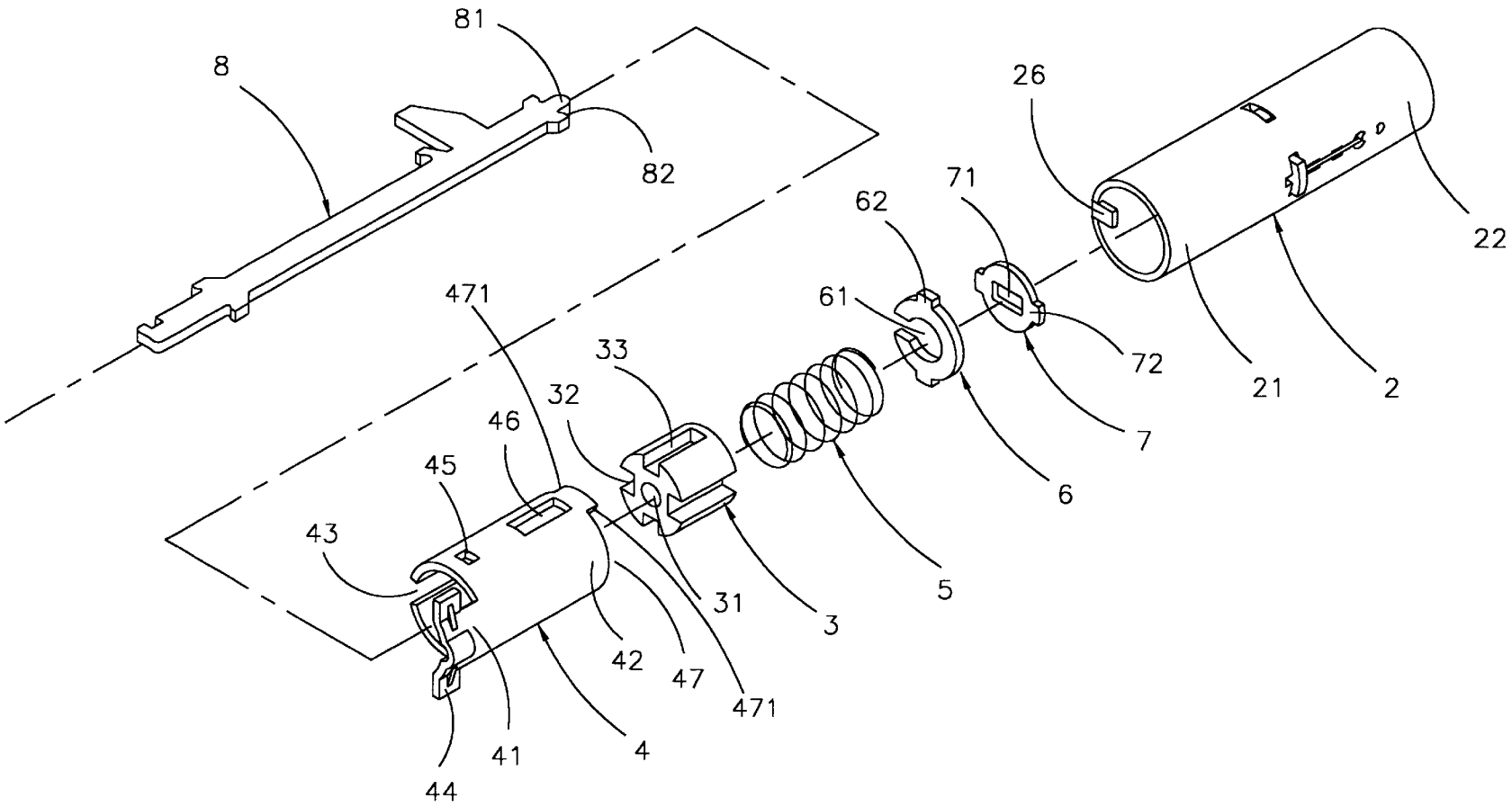
FIG. 3 is an exploded view to illustrate in more detail an outside spindle tube of the door lock and the components inside the outside spindle tube.

Referring to FIGS. 1 to 3, a door lock embodying the present invention includes an inside spindle tube 1 connected to an inside handle 92 and a press button 13, and an outside spindle tube 2 connected to an outside handle 91. The inside and outside spindle tubes 1, 2 and the inside and outside handles 92, 91 are mountable on a door in a conventional manner via respective mounting cap assemblies 15 which incorporate returning spring units 15A for returning the handles 92, 91 after the handles 92, 91 are rotated.

The press button 13 is connected to one end of a spindle rod 8 that passes through the inside spindle tube 1. Another end of the spindle rod 8 extends to the second end 21 of the outside spindle tube 2. A key-operated lock 12 is mounted inside the outside spindle tube 2.

The outside spindle tube 2 has a first end 22 connected to the outside handle 91, and a second end 21 formed with a first engaging member 26 which projects radially inward from the peripheral wall of the outside spindle tube 2.

An insert tube 4 is inserted into the outside spindle tube 2 through the second end 21. The insert tube 4 includes a third end 41 extending adjacent to the second end 21 of the outside spindle tube 2, and a fourth end 42 extending inside the outside spindle tube 2 intermediate the first and second ends 22, 21. The third end 41 of the insert tube 4 extends inwardly of the first engaging member 26 of the outside spindle tube 2 so as to be free from engagement with the first engaging member 26. A latch operating tab 44 projects outward from the third end 41 of the insert tube 4 so as to drive a latch operating mechanism 10. The latch operating mechanism 10 is mounted inside a cylindrical case 101 in a conventional manner and is used to operate a latch bolt 14 that controls the locking and unlocking of a door (not shown). The fourth end 42 of the insert tube 4 is formed with a notched edge 47 which extends circumferentially within a predetermined angular distance and has a constant axial depth from the fourth end 42. Two shoulders 471 are formed at two circumferentially opposed ends of the notched edge 47. The insert tube 4 further includes a second engaging member 45 projecting inwardly from the inner wall of the insert tube, an axially extending slide groove 43, and a pair of diametrically opposed slots 46.

A fixing plate 6, which has a substantially C-shaped cross-section, is fittingly inserted into the insert tube 4 adjacent to the fourth end 42. The fixing plate 6 has a central hole 61, and two diametrically opposed radial lugs 62 to respectively engage the slots 46 of the insert tube 4.

A clutch member 3 is disposed inside the insert tube 4 and has a central hole 31 for extension of a drive end 81 of the spindle rod 8. The outer peripheral surface of the clutch member 3, which confronts the inner surface of the insert tube 4, is formed with a first axial groove 32 to slidably engage the first engaging member 26 of the outside spindle tube 2, and a second axial groove 33 to slidably engage the second engaging member 45 of the insert tube 4. The clutch member 3 is movable axially between a first position (see FIG. 4) in which the first engaging member 26 engages slidably the first axial groove 32 and a second position (see FIG. 5) in which the first engaging member 26 disengages from the first axial groove 32. A spring 5 is disposed inside the insert tube 4 between the fixing plate 6 and the clutch member 3 to urge the clutch member 3 to the first position. The clutch member 3 can be moved against the action of the spring 5 to the second position when two shoulders 82 formed at the drive end 81 of the spindle rod 8 push the clutch member 3.

A driving plate 7 is mounted inside the outside spindle tube 2 adjacent to the fourth end 42 of the insert tube 4, and includes a pair of projections 72 extending into the notched edge 47 at the fourth end 42 of the insert tube 4, and a central hole 71 for insertion of a lock core stem 11 of the key-operated lock 12.

Figure 4:
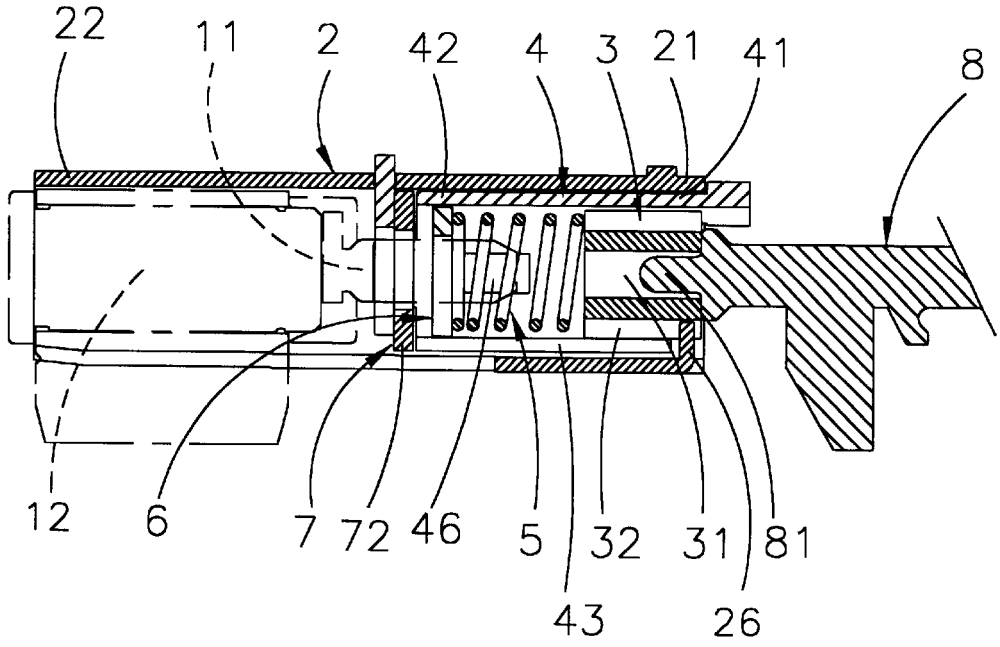
FIG. 4 is a fragmentary sectional view of the door lock with a clutch member being in engagement with the outside spindle tube.

As shown in FIG. 4, when the press button 13 is not pressed, the door lock is in an unlocking position and the clutch member 3 is at its first position. In this situation, the first axial groove 32 of the clutch member 3 is in engagement with the first engaging member 26 of the outside spindle tube 2. Since the second engaging member 45 of the insert tube 4 engages the second axial groove 33 of the clutch member 3, the insert tube 4 and the outside spindle tube 2 are held together so that the rotation of the outside spindle tube 2 is transmitted to the insert tube 4 and causes the insert tube 4 to operate the latch bolt 14.

Figure 5:
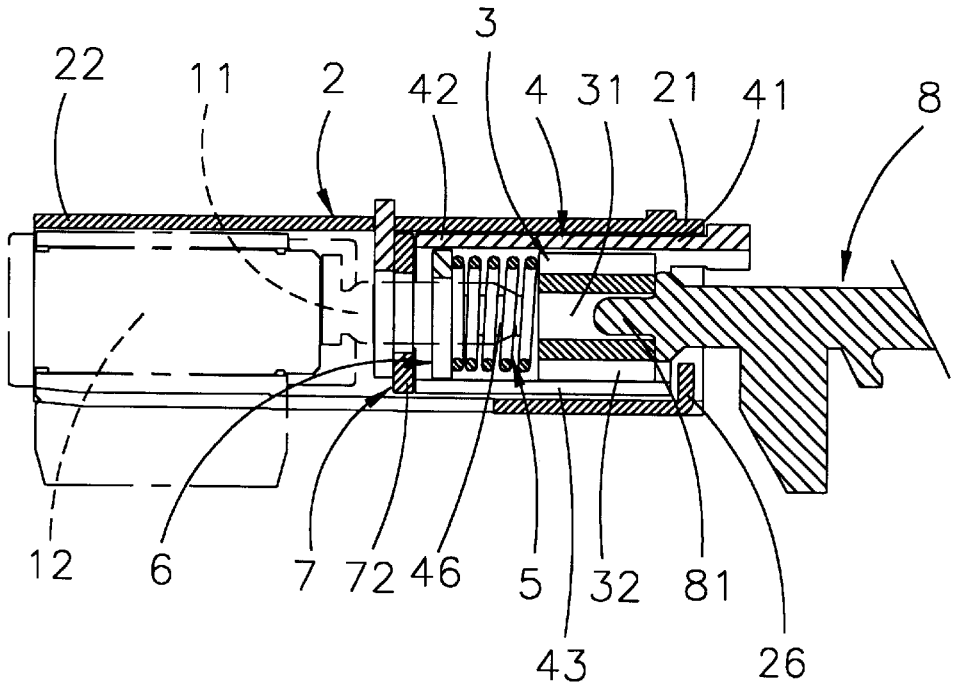
FIG. 5 is a fragmentary sectional view of the door lock with the clutch member being disengaged from the outside spindle tube.

When the press button 13 is pressed, the spindle rod 8 pushes the clutch member 3 so that the clutch member 3 is moved to the second position, as shown in FIG. 5. In this situation, the door lock is in its locking position, and the first axial groove 32 of the clutch member 3 disengages from the first engaging member 26 of the outside spindle tube 2 so that the outside spindle tube 2 will rotate idly within a predetermined angle relative to the insert tube 4 when the outside handle 91 is rotated. Although the rotation of the outside spindle tube 2 can rotate the driving plate 7 via the key-operated lock 12 and the lock core stem 11, the driving plate 7 does not move the insert tube 4 as the projections 72 slide along and within the notched edge 47 of the insert tube 4. After the outside handle 91 is rotated to a predetermined angle, it is returned to an original position by the returning spring unit 15A.

When the key-operated lock 12 is operated by a key, the key will cause the lock core stem 11 and the driving plate 7 to rotate so that the projections 72 of the driving plate 7 rotate idly along the notched edge 47 to a particular angle until the projections 72 reach the shoulders 471 and subsequently drive the insert tube 4. The latch operating tab 44 of the insert tube 4 in turn drives the latch mechanism 10, thus moving the latch bolt 14 to an unlatching position. As the latch bolt 14 is the unlatching position, the spindle rod 8 is urged by the spring 5 to move to its original position. In this situation, the insert tube 4 and the outside spindle tube 2 are interengaged once again.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A door lock comprising:

an inside handle incorporating a press button;

an outside handle;

an outside spindle tube including a first end connected to said outside handle, a second end opposite to said first end, and a first engaging member projecting radially inward from said second end;

an insert tube inserted into said outside spindle tube through said second end, and including a third end adjacent said second end, a fourth end extending inside said outside spindle tube, and a latch operating tab which projects from said third end to extend outwardly of said third end and which is adapted to operate a latch operating mechanism, said insert tube further having an inner wall and a second engaging member projecting inwardly forms aid inner wall between said third and fourth ends, wherein said insert tube is not axially movable;

a clutch member disposed inside said insert tube and having an outer peripheral surface formed with first and second axial grooves, said second axial groove engaging said second engaging member of said insert tube, said clutch member being axially movable between a first position in which said first engaging member engages slidably said first axial groove and a second position in which said first engaging member disengages from said first axial groove;

a spring disposed inside said insert tube to urge said clutch member toward said third end so as to place said clutch member in said first position; and a spindle rod having one end connected to said press button and another end connected to said clutch member so as to move said clutch member to said second position when said press button is pressed.

2. The door lock as claimed in claim 1, wherein said insert tube further includes a fixing plate which is mounted inside said insert tube adjacent to said fourth end of said insert tube, said spring being disposed between said fixing plate and said clutch member.

3. The door lock as claimed in claim 2, wherein said fixing plate includes a pair of diametrically opposed lugs, said insert tube having two opposed slots to respectively engage said lugs.

4. The door lock as claimed in claim 3, wherein said fixing plate further includes a central hole.

5. The door lock as claimed in claim 1, wherein said insert tube further includes a notched edge formed at said fourth end, said notched edge extending circumferentially and having a depth from said fourth end, said insert tube further including two shoulders respectively formed at two circumferentially opposed ends of said notched edge, the door lock further comprising a driving plate rotatably disposed inside said outside spindle tube adjacent said notched edge, said driving plate having a substantially central slot, and a projection extending radially for moving along said notched edge.

6. A door lock comprising:

an inside handle incorporating a press button;

an outside handle;

an outside spindle tube including a first end connected to said outside handle, a second end opposite to said first end, and a first engaging member projecting radially inward from said second end;

an insert tube inserted into said outside spindle tube through said second end, and including a third end adjacent said second end, a fourth end extending inside said outside spindle tube, and a latch operating tab which projects from said third end to extend outwardly of said third end and which is adapted to operate a latch operating mechanism, said insert tube being free from engagement with said first engaging member, said insert tube further having an inner wall and a second engaging member projecting inwardly from said inner wall between said third and fourth ends, wherein said insert tube is not axially movable;

a clutch member disposed inside said insert tube and having an outer peripheral surface formed with first and second axial grooves, said second axial groove engaging said second engaging member of said insert tube, said clutch member being axially movable between a first position in which said first engaging member engages slidably said first axial groove and a second position in which said first engaging member disengages from said first axial groove;

a spring disposed inside said insert tube to urge said clutch member toward said third end so as to place said clutch member in said first position; and a spindle rod having one end connected to said press button and another end connected to said clutch member so as to move said clutch member to said second position when said press button is pressed.

7. The door lock as claimed in claim 1, wherein said third end of said insert tube extends inwardly of said first engaging member of said outside spindle tube.

* * * * *